US009113766B2

(12) United States Patent
Tuller et al.

(10) Patent No.: US 9,113,766 B2
(45) Date of Patent: Aug. 25, 2015

(54) METHOD AND APPARATUS FOR DISHWASHER WITH COMMON HEATING ELEMENT FOR MULTIPLE TREATING CHAMBERS

(75) Inventors: Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 146 days.

(21) Appl. No.: 12/947,317

(22) Filed: Nov. 16, 2010

(65) Prior Publication Data

US 2012/0118330 A1 May 17, 2012

(51) Int. Cl.

| | |
|---|---|
| ***A47L 15/42*** | (2006.01) |
| ***A47L 15/00*** | (2006.01) |
| ***A47L 15/46*** | (2006.01) |

(52) U.S. Cl.

CPC ..... *A47L 15/0084* (2013.01); *A47L 15/0047* (2013.01); *A47L 15/4285* (2013.01); *A47L 15/46* (2013.01); *A47L 15/4293* (2013.01); *A47L 2401/12* (2013.01); *A47L 2401/18* (2013.01); *A47L 2401/19* (2013.01); *A47L 2401/26* (2013.01); *A47L 2501/06* (2013.01); *A47L 2501/11* (2013.01); *A47L 2501/12* (2013.01); *A47L 2501/26* (2013.01)

(58) Field of Classification Search

USPC ..... 134/25.2, 56 D, 57 D, 58 D, 58 DL, 105

See application file for complete search history.

(56) References Cited

U.S. PATENT DOCUMENTS

| | | | | |
|---|---|---|---|---|
| 1,617,021 | A | | 2/1927 | Mitchell |
| 2,154,559 | A | | 4/1939 | Bilde |
| 2,422,022 | A | | 6/1947 | Koertge |
| 2,734,122 | A | | 2/1956 | Flannery |
| 3,016,147 | A | | 1/1962 | Cobb et al. |
| 3,026,628 | A | | 3/1962 | Berger, Sr. et al. |
| 3,068,877 | A | * | 12/1962 | Jacobs ..... 134/99.1 |
| 3,103,227 | A | | 9/1963 | Long |
| 3,122,148 | A | | 2/1964 | Alabaster |
| 3,186,417 | A | | 6/1965 | Fay |
| 3,288,154 | A | | 11/1966 | Jacobs |
| 3,542,594 | A | | 11/1970 | Smith et al. |
| 3,575,185 | A | | 4/1971 | Barbulesco |
| 3,586,011 | A | | 6/1971 | Mazza |
| 3,739,145 | A | | 6/1973 | Woehler |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

European Search Report for EP11188106, Mar. 29, 2012.

(Continued)

*Primary Examiner* — Michael Barr
*Assistant Examiner* — Benjamin L Osterhout

(57) ABSTRACT

A dishwasher with multiple, physically separate treating chambers includes a liquid supply system supplying liquid to the treating chambers, an air supply system supplying air to the treating chambers, and a common heating element for simultaneously heating the air and liquid. A method for operating a dishwasher including simultaneously heating the air and the liquid with a common heating element is also provided.

20 Claims, 7 Drawing Sheets

(56) References Cited

U.S. PATENT DOCUMENTS

| | | | | |
|---|---|---|---|---|
| 3,801,280 | A | 4/1974 | Shah et al. | |
| 3,846,321 | A | 11/1974 | Strange | |
| 3,906,967 | A | 9/1975 | Bergeson | |
| 3,989,054 | A | 11/1976 | Mercer | |
| 4,179,307 | A * | 12/1979 | Cau et al. | 134/58 D |
| 4,180,095 | A | 12/1979 | Woolley et al. | |
| 4,326,552 | A | 4/1982 | Bleckmann | |
| 4,754,770 | A | 7/1988 | Fornasari | |
| 5,002,890 | A | 3/1991 | Morrison | |
| 5,030,357 | A | 7/1991 | Lowe | |
| 5,133,863 | A | 7/1992 | Zander | |
| 5,331,986 | A | 7/1994 | Lim et al. | |
| 5,454,298 | A | 10/1995 | Lu | |
| 5,470,142 | A | 11/1995 | Sargeant et al. | |
| 5,470,472 | A | 11/1995 | Baird et al. | |
| 5,557,704 | A | 9/1996 | Dennis et al. | |
| 5,569,383 | A | 10/1996 | Vander Ark, Jr. et al. | |
| 5,618,424 | A | 4/1997 | Nagaoka | |
| 5,711,325 | A | 1/1998 | Kloss et al. | |
| 5,755,244 | A * | 5/1998 | Sargeant et al. | 134/46 |
| 5,782,112 | A | 7/1998 | White et al. | |
| 5,803,100 | A | 9/1998 | Thies | |
| 5,865,997 | A | 2/1999 | Isaacs | |
| 5,868,937 | A | 2/1999 | Back et al. | |
| 5,904,163 | A | 5/1999 | Inoue et al. | |
| 5,924,432 | A | 7/1999 | Thies et al. | |
| 6,289,908 | B1 | 9/2001 | Kelsey | |
| 6,460,555 | B1 * | 10/2002 | Tuller et al. | 134/200 |
| 6,491,049 | B1 | 12/2002 | Tuller et al. | |
| 6,601,593 | B2 | 8/2003 | Deiss et al. | |
| 6,666,976 | B2 | 12/2003 | Benenson, Jr. et al. | |
| 6,800,197 | B1 | 10/2004 | Kosola et al. | |
| 6,997,195 | B2 | 2/2006 | Durazzani et al. | |
| 7,047,986 | B2 | 5/2006 | Ertle et al. | |
| 7,069,181 | B2 | 6/2006 | Jerg et al. | |
| 7,093,604 | B2 | 8/2006 | Jung et al. | |
| 7,153,817 | B2 | 12/2006 | Binder | |
| 7,198,054 | B2 | 4/2007 | Welch | |
| 7,208,080 | B2 | 4/2007 | Batten et al. | |
| 7,232,494 | B2 | 6/2007 | Rappette | |
| 7,250,174 | B2 | 7/2007 | Lee et al. | |
| 7,270,132 | B2 | 9/2007 | Inui et al. | |
| 7,319,841 | B2 | 1/2008 | Bateman, III et al. | |
| 7,326,338 | B2 | 2/2008 | Batten et al. | |
| 7,347,212 | B2 | 3/2008 | Rosenbauer | |
| 7,350,527 | B2 | 4/2008 | Gurubatham et al. | |
| 7,363,093 | B2 | 4/2008 | King et al. | |
| 7,363,096 | B2 | 4/2008 | King et al. | |
| 7,406,843 | B2 | 8/2008 | Thies et al. | |
| 7,445,013 | B2 | 11/2008 | VanderRoest et al. | |
| 7,497,222 | B2 | 3/2009 | Edwards et al. | |
| 7,523,758 | B2 | 4/2009 | VanderRoest et al. | |
| 7,594,513 | B2 | 9/2009 | VanderRoest et al. | |
| 7,819,983 | B2 | 10/2010 | Kim et al. | |
| 7,896,977 | B2 | 3/2011 | Gillum et al. | |
| 8,043,437 | B1 | 10/2011 | Delgado et al. | |
| 8,161,986 | B2 | 4/2012 | Alessandrelli | |
| 8,215,322 | B2 | 7/2012 | Fountain et al. | |
| 8,667,974 | B2 | 3/2014 | Fountain et al. | |
| 8,746,261 | B2 | 6/2014 | Welch | |
| 2002/0017483 | A1 | 2/2002 | Chesner et al. | |
| 2003/0037809 | A1 | 2/2003 | Favaro | |
| 2003/0205248 | A1 | 11/2003 | Christman et al. | |
| 2004/0007253 | A1 | 1/2004 | Jung et al. | |
| 2004/0103926 | A1 | 6/2004 | Ha | |
| 2005/0022849 | A1 | 2/2005 | Park et al. | |
| 2005/0133070 | A1 | 6/2005 | Vanderroest et al. | |
| 2006/0005863 | A1 | 1/2006 | Gurubatham et al. | |
| 2006/0054549 | A1 | 3/2006 | Schoendorfer | |
| 2006/0123563 | A1 | 6/2006 | Raney et al. | |
| 2006/0162744 | A1 | 7/2006 | Walkden | |
| 2006/0174915 | A1 | 8/2006 | Hedstrom et al. | |
| 2006/0236556 | A1 | 10/2006 | Ferguson et al. | |
| 2006/0237049 | A1 | 10/2006 | Weaver et al. | |
| 2007/0006898 | A1 * | 1/2007 | Lee | 134/10 |
| 2007/0107753 | A1 | 5/2007 | Jerg | |
| 2007/0163626 | A1 | 7/2007 | Klein | |
| 2007/0186964 | A1 * | 8/2007 | Mason et al. | 134/56 D |
| 2007/0246078 | A1 | 10/2007 | Purtilo et al. | |
| 2007/0266587 | A1 | 11/2007 | Bringewatt et al. | |
| 2008/0116135 | A1 | 5/2008 | Rieger et al. | |
| 2008/0289654 | A1 | 11/2008 | Kim et al. | |
| 2008/0289664 | A1 | 11/2008 | Rockwell et al. | |
| 2009/0095330 | A1 | 4/2009 | Iwanaga et al. | |
| 2009/0283111 | A1 | 11/2009 | Classen et al. | |
| 2010/0012159 | A1 | 1/2010 | Verma et al. | |
| 2010/0043826 | A1 | 2/2010 | Bertsch et al. | |
| 2010/0043828 | A1 | 2/2010 | Choi et al. | |
| 2010/0043847 | A1 | 2/2010 | Yoon et al. | |
| 2010/0121497 | A1 | 5/2010 | Heisele et al. | |
| 2010/0154830 | A1 | 6/2010 | Lau et al. | |
| 2010/0154841 | A1 | 6/2010 | Fountain et al. | |
| 2010/0224223 | A1 | 9/2010 | Kehl et al. | |
| 2010/0252081 | A1 | 10/2010 | Classen et al. | |
| 2010/0300499 | A1 | 12/2010 | Han et al. | |
| 2011/0061682 | A1 | 3/2011 | Fountain et al. | |
| 2011/0120508 | A1 | 5/2011 | Yoon et al. | |
| 2011/0126865 | A1 | 6/2011 | Yoon et al. | |
| 2011/0146714 | A1 | 6/2011 | Fountain et al. | |
| 2011/0146730 | A1 | 6/2011 | Welch | |
| 2011/0146731 | A1 | 6/2011 | Fountain et al. | |
| 2012/0097200 | A1 | 4/2012 | Fountain | |
| 2012/0138107 | A1 | 6/2012 | Fountain et al. | |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | B | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | A1 | 10/1991 |
| DE | 4016915 | A1 | 11/1991 |
| DE | 4131914 | A1 | 4/1993 |
| DE | 9415486 | U1 | 11/1994 |
| DE | 9416710 | U1 | 12/1994 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | | 6/2011 |
| DE | 102011052846 | A1 | 5/2012 |
| DE | 102012103435 | A1 | 12/2012 |
| EP | 0068974 | A1 | 1/1983 |

(56) References Cited

FOREIGN PATENT DOCUMENTS

| | | | |
|---|---|---|---|
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 0752231 | A1 | 1/1997 |
| EP | 752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1703834 | A1 | 9/2006 |
| EP | 1743871 | A1 | 1/2007 |
| EP | 1862104 | A1 | 12/2007 |
| EP | 1882436 | A1 | 1/2008 |
| EP | 1583455 | B1 | 10/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | | 6/2011 |
| EP | 2338400 | | 6/2011 |
| EP | 2351507 | | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

German Search Report for DE102010061346, Sep. 30, 2011.
German Search Report for DE102010061343, Jul. 7, 2011.
German Search Report for DE102010061342, Aug. 19, 2011.
European Search Report for EP101952380, May 19, 2011.
German Search Report for DE102011053666, Oct. 21, 2011.
German Search Report for DE102010061347, Jan. 23, 2013.
German Search Report for DE102010061215, Feb. 7, 2013.
European Search Report for EP12188007, Aug. 6, 2013.
German Search Report for DE102013103264, Jul. 12, 2013.
German Search Report for DE102013103625, Jul. 19, 2013.
Ishihara et al., JP 11155792 A, English Machine Translation, 1999, pp. 1-14.
German Search Report for Counterpart DE102014101260.7, Sep. 18, 2014.
German Search Report for Counterpart DE102013109125, Dec. 9, 2013.

* cited by examiner

METHOD AND APPARATUS FOR DISHWASHER WITH COMMON HEATING ELEMENT FOR MULTIPLE TREATING CHAMBERS

BACKGROUND OF THE INVENTION

Dishwashers can include multiple compartments in the form of multiple drawers or pull-out compartments slidably mounted in a cabinet. Each compartment can include a tub at least partially defining a treating chamber. Typically, a dish rack is provided in each treating chamber to support utensils during a treating cycle of operation. In most multi-compartment dishwashers, duplicate components, including duplicate pumps, sumps, and heaters, are provided for each treating chamber for carrying out a cycle of operation in one or both of the treating chambers. Additionally, separate heaters are normally employed for heating liquid used to wash the utensils and heating air used to dry the utensils.

SUMMARY OF THE INVENTION

The invention relates to a method and apparatus including a dishwasher having multiple treating chambers and a common heating element that simultaneously heats air and liquid supplied to the multiple treating chambers.

DESCRIPTION OF EMBODIMENTS OF THE INVENTION

Figure 1:
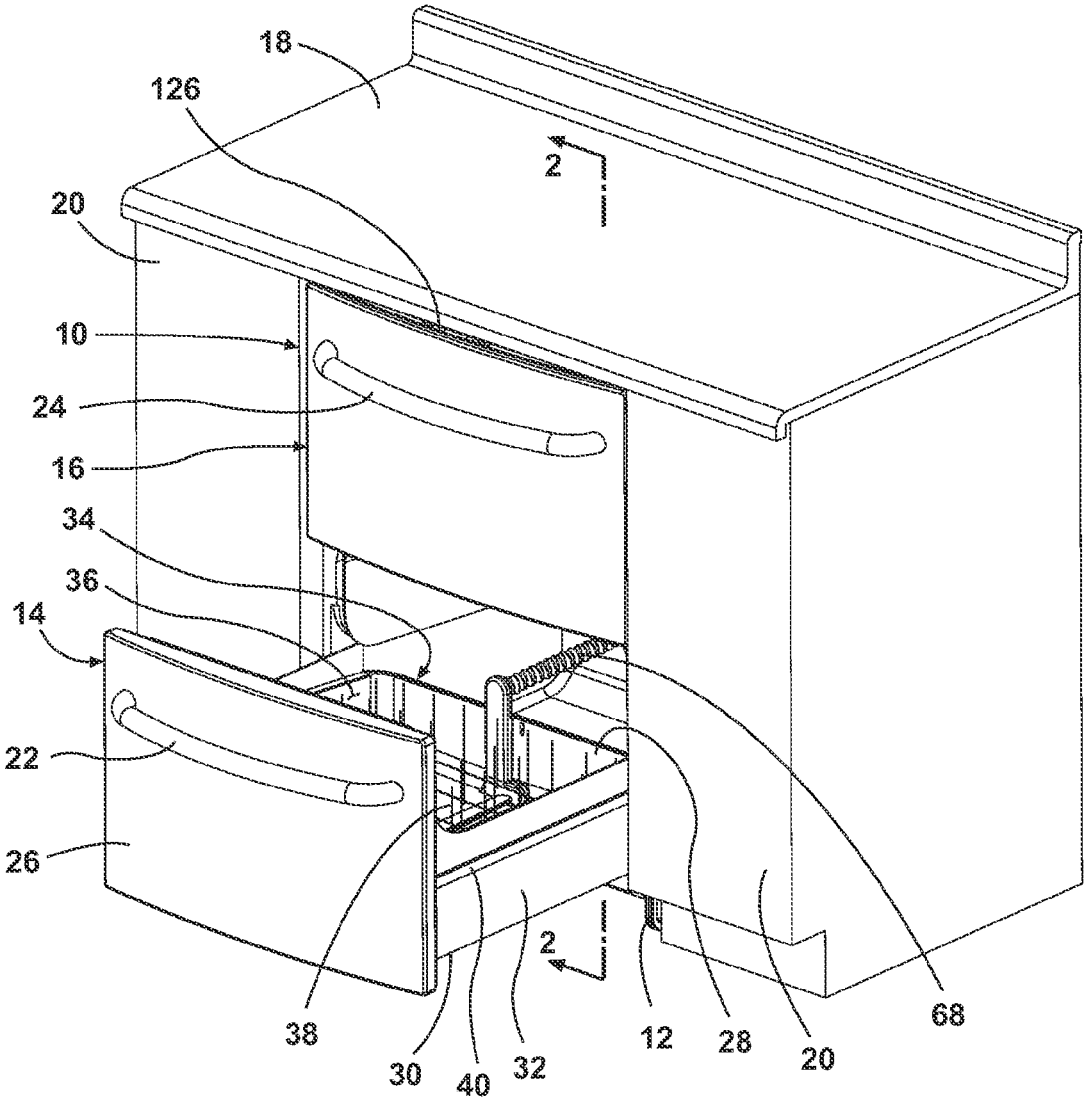
FIG. 1 is a perspective view of a multi-compartment dishwasher according to a first embodiment of the present invention having an upper compartment in a closed position and a lower compartment in an open position.

FIG. 1 is a perspective view of a dishwasher 10 according to the present invention. Although the actual dishwasher 10 into which the present invention may be incorporated can vary, the invention is shown in connection with dishwasher 10 depicted as a multi-compartment drawer-type dishwasher. The dishwasher 10 includes an outer housing or frame 12 having a lower compartment 14 and an upper compartment 16 arranged below a countertop 18 between cabinetry 20, which may include one or more drawers or cabinet drawers (not shown). As best illustrated in FIG. 1, the lower and upper compartments 14, 16 take the form of slide-out drawer units of similar size, each having a handle 22, 24, respectively, for facilitating movement of the drawer units between an open and closed position. However, one compartment 14, 16 can have a small or medium capacity so as to be used for washing smaller or more delicate utensils, such as glassware and the like, while the other compartment 14, 16 can be a larger capacity drawer for washing larger or more robust utensils, such as dinnerware, cookware and other large sized objects. Also, the dishwasher 10 could include a combination single pull-out drawer unit and a conventional dishwashing unit, with a hinged door. As used in this description, the term "utensil(s)" is intended to be generic to any item, single or plural, that may be treated in the dishwasher 10, including, without limitation; dishes, plates, pots, bowls, pans, glassware, and silverware.

Lower compartment 14 is shown in the open position in FIG. 1, and includes a front wall 26, a rear wall 28, a bottom wall 30 and opposing side walls 32 that collectively form a lower tub 34 that defines a lower treating chamber 36. The lower tub 34 is provided with a utensil rack 38 for supporting various objects, such as utensils and the like, to be exposed to a washing operation. Lower compartment 14 is slidingly supported within the outer housing through a pair of extendible support guides, one of which is indicated at 40.

Figure 2:
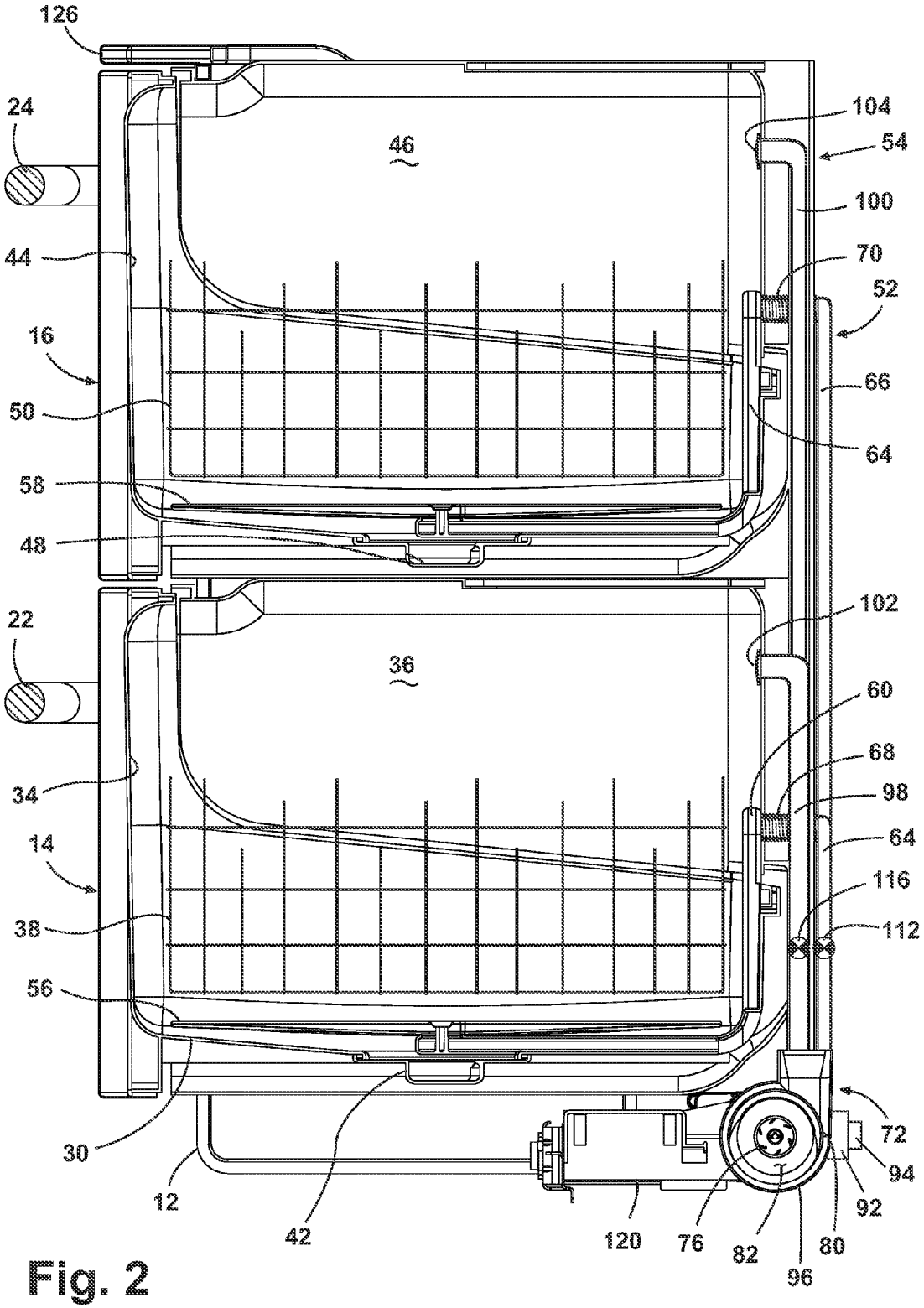
FIG. 2 is a cross-sectional view through line 2-2 of FIG. 1, with the upper and lower compartments shown in the closed position.

FIG. 2 is a cross-section view through line 2-2 of FIG. 1, with both compartments 14, 16 shown in the closed position. In the embodiment shown, the bottom wall 30 of the lower tub 34 may be sloped to define a lower tub region or tub sump 42 that, as will be discussed more fully below, manages a flow of washing fluid within lower compartment 14. Although not numbered in FIG. 2, upper compartment 16 similarly includes front, rear, bottom and opposing side walls that collectively form an upper tub 44 that defines an upper treating chamber 46 having a sump 48. The upper treating chamber 46 is physically separate from the lower treating chamber 36. The upper tub 44 can also be provided with a utensil rack 50 for supporting various objects, such as utensils and the like, to be exposed to a washing operation. Like the lower compartment 14, upper compartment 16 is slidingly supported within the outer housing through a pair of extendible support guides (not shown).

The dishwasher 10 includes a liquid supply system 52 and an air supply system 54, each of which is fluidly coupled to at least one of the lower and upper treating chambers 36, 46. For example, the liquid supply system 52 can be coupled to the lower treating chamber 36 and the air supply system 54 can be coupled to the upper treating chamber 46, or vice versa. As illustrated, the liquid supply system 52 is fluidly coupled to both treating chambers 36, 46 to selectively supply liquid to the tubs 34, 44 and the air supply system 54 is fluidly coupled to both treating chambers 36, 46 to selectively supply air to the tubs 34, 44.

The liquid supply system 54 includes a lower spray arm assembly 56 positioned in the lower tub 34 beneath the utensil rack 38 and an upper spray arm assembly 58 positioned in the upper tub 44 beneath the utensil rack 50. Each spray arm assembly 56, 58 is configured to rotate in their respective treating chamber 36, 46 and generate a spray of wash liquid in a generally upward direction, over a portion of the interior of their respective treating chamber 36, 46, typically directed to treat utensils located in the utensil racks 38, 50. While the spray arm assemblies 56, 58 are illustrated as rotating spray arms, the spray arm assemblies can be of any structure and configuration, such as fixed spray heads. Additional spray arms or nozzles can also be provided.

A first spray arm conduit 60 is provided in the lower tub 34 and is coupled at one end to the lower spray arm assembly 56. As illustrated, the first spray arm conduit 60 extends along the bottom wall 30 of the lower tub 34 from the lower spray arm assembly 56 and upwardly along the rear wall 28. A first supply conduit 62 is fluidly coupled to the first spray arm conduit 60 for supplying liquid to the spray arm assembly 56 via the first spray arm conduit 60. The upper tub 44 is provided with a second spray arm conduit 64 that is similar to the first spray arm conduit 60, and a second supply conduit 66 is fluidly coupled to the upper tub 44 for supplying liquid to the spray arm assembly 58 via the second spray arm conduit 64. Because the spray arm assemblies 56, 58 are positioned within the tubs 34, 44, the spray arm assemblies 56, 58 and the spray arm conduits 60, 64 must be able to move with the compartments 14, 16 as they move between the open and closed positions. As such, a flexible manifold tube 68, 70 can be fluidly coupled between each of the spray arm conduits 60, 64 and their associated supply conduits 62, 66 to allow for such movement. Alternatively, it has been contemplated that a docking-type connection may be used instead of the flexible manifold tubes 68, 70.

Figure 3:
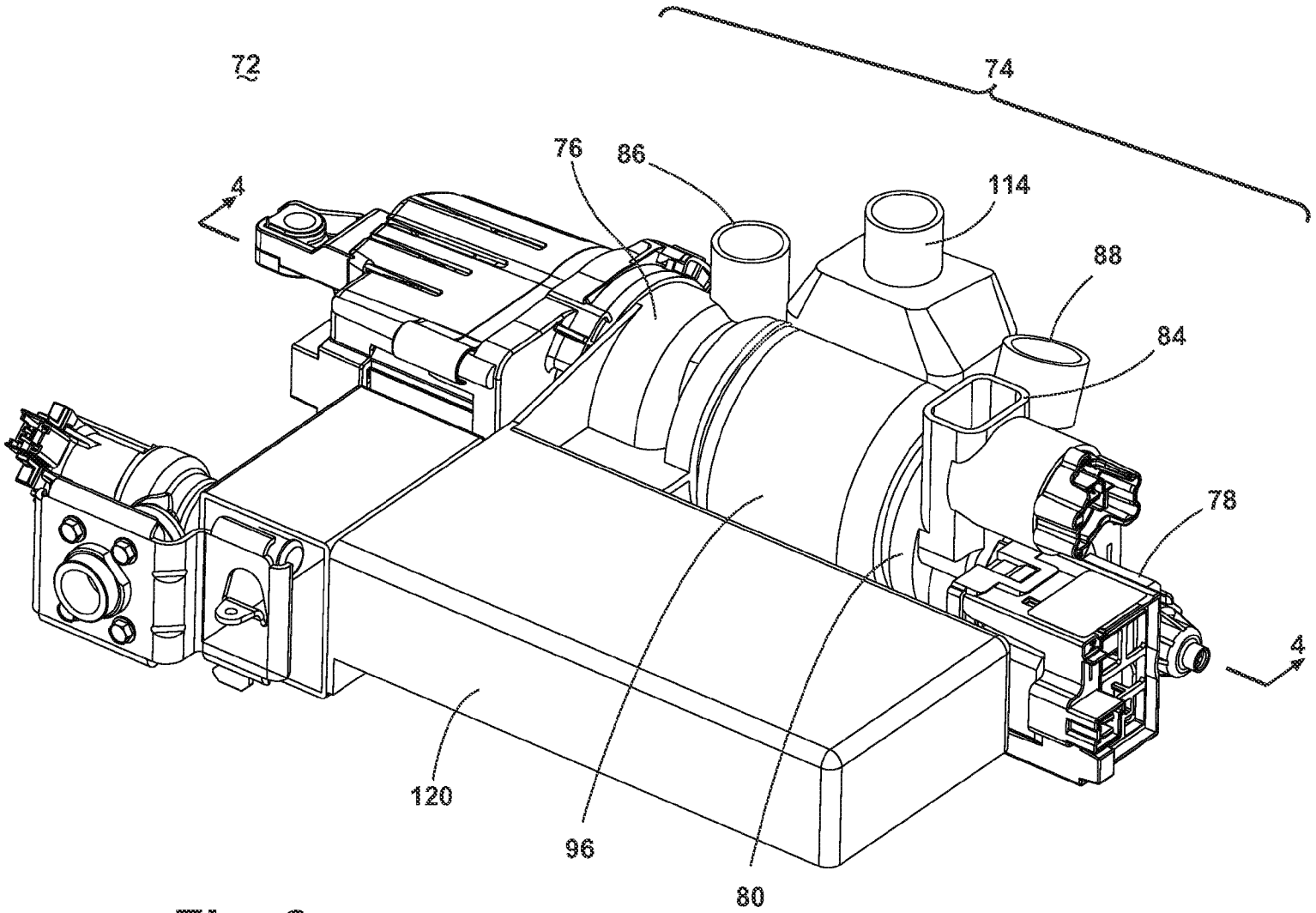
FIG. 3 is a perspective view of the remote pump/filtration/heating system in isolation from the dishwasher 10.
Figure 4:
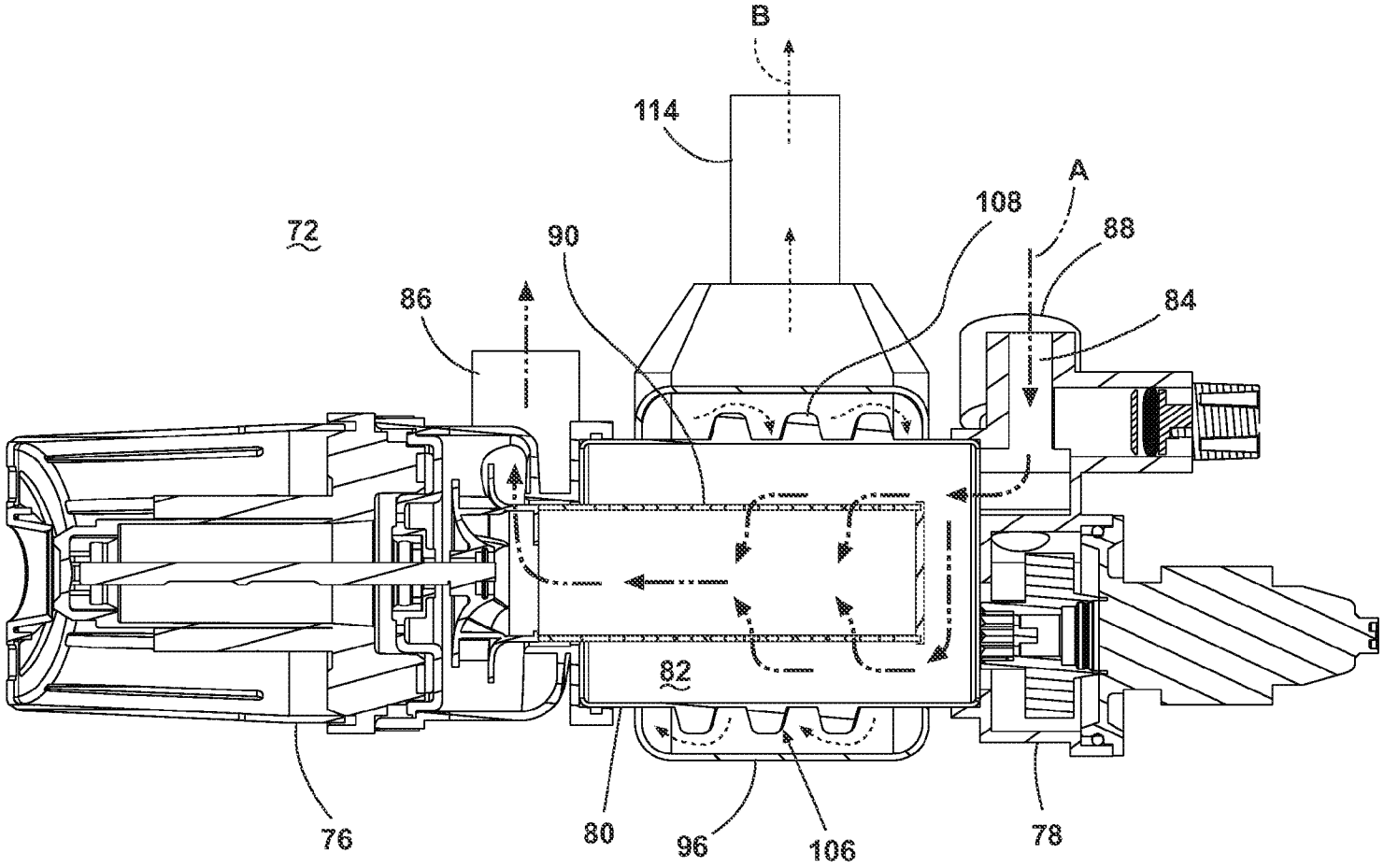
FIG. 4 is a cross-section view through line 4-4 of FIG. 3.

The liquid supply system 52 can further include a remote pump/filtration/heating system 72 for both compartments 14, 16. FIG. 3 is a perspective view of the remote pump/filtration/heating system 72 in isolation from the dishwasher 10 and FIG. 4 is a cross-section view through line 4-4 of FIG. 3. The remote system 72 can include a single pump assembly 74 to pump liquid to the spray arm assemblies 56, 58. The pump assembly 74 may have both a recirculation pump 76 and a drain pump 78, which are fluidly coupled to a housing 80 defining a remote sump 82 for both treating chambers 36, 46. The remote sump 82 is in fluid communication with both tub sumps 34, 48 by conduits (not shown) that are both in fluid communication with a sump inlet conduit 84. The remote sump 82 may collect liquid supplied to both wash tubs 34, 44; as such, the housing 80 can be thought of as a liquid supply housing or conduit.

The recirculation pump 76 is fluidly coupled to the remote sump 82 and includes an outlet conduit 86 in communication with the first and second supply conduits 62 such that the recirculation pump 76 can selectively pump liquid through the supply conduits 62, 66 to each of the spray arm assemblies 56, 58. In this way, the recirculation pump 76 can redistribute wash liquid collecting in the remote sump 82 through the spray arm assemblies 56, 58 into the treating chambers 36, 46, where the liquid naturally flows back to the remote sump 82 via the tub sumps 42, 48 for recirculation or drainage, depending on the phase of the wash cycle. The drain pump 78 may be used to drain liquid from the remote sump 82, through a drain conduit 88, and out of the dishwasher 10.

Referring to FIGS. 2 and 4, the sump inlet conduit 84, tub sumps 42, 48, remote sump 82, recirculation pump 76, spray arm assemblies 56, 58, and conduits 60-66 collectively form a liquid flow path of the liquid supply system 52. A filter 90 is provided within the liquid flow path such that soil and foreign objects may be filtered from the liquid. As illustrated, the filter 90 is located in the housing 80. The filter 90 may be a fine filter, which may be utilized to remove smaller particles from the liquid. The filter 90 may be a rotating filter as is set forth in detail in U.S. patent application Ser. No. 12/643,394, filed Dec. 21, 2009, and titled "Rotating Drum Filter for a Dishwashing Machine," which is incorporated herein by reference in its entirety. The rotating filter according to U.S. patent application Ser. No. 12/643,394 may be operably coupled to an impeller of the recirculation pump 76 such that when the impeller rotates the filter 90 is also rotated. While not illustrated, at least one an additional filter and/or coarse strainer can be located between the tub sumps 42, 48 and the remote sump 82 to filter larger soils and debris but allow smaller particles to pass through. An additional filter may be provided for each compartment 14, 16, and may be a strainer which is provided at each of the tub sumps 42, 48.

Figure 5:
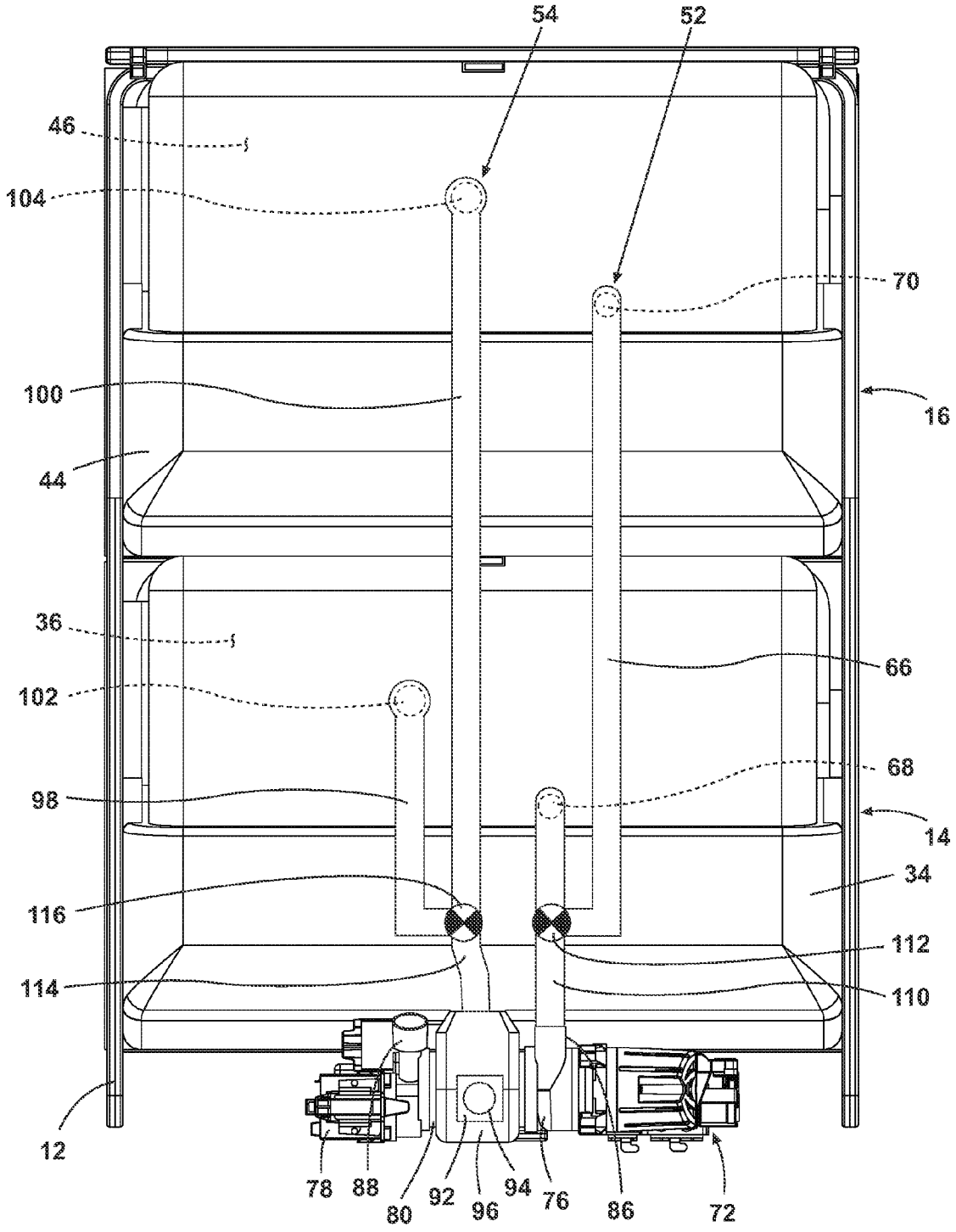
FIG. 5 is a rear view of the dishwasher of FIG. 1.

FIG. 5 is a rear view of the dishwasher 10 of FIG. 1. The air supply system 54 includes a fan or blower 92 having a blower inlet conduit 94 in fluid communication with the ambient surroundings to intake air from the exterior of the dishwasher 10 and a blower outlet conduit 96 for providing air to the treating chambers 36, 46 via one or more air conduits. As illustrated, the air supply system 54 includes a first air conduit 98 fluidly coupled to the lower tub 34 for supplying air to the lower treating chamber 36 and a second air conduit 100 fluidly coupled to the upper tub 44 for supplying air to the upper treating chamber 46. As illustrated, a portion of the blower outlet conduit 96 may wrap around the housing 80, such that the housing 80 defines an inner wall of the blower outlet conduit 96. In this manner, the housing 80 is a shared wall of the liquid supply system 52 and the air supply system 54, which places the liquid supply system 52 and the air supply system 54 in conductive contact. One or more valves or other closing means (not shown) may be used to close off the fluid connection between the blower outlet conduit 96 and the tubs 34, 44 during certain portions of the cycle of operation so that liquid does not enter the blower outlet conduit 96. Inlet vents 102, 104 can be provided in each of the compartments 14, 16, and may be in fluid communication with air conduits 98, 100 for passing air into the treating chambers 36, 46. Additional outlet vents (not shown) can be provided in each of the compartments 14, 16 and may be in fluid communication with the surrounding air, either internal or external to the dishwasher, to allow air in the treating chambers 36, 46 to be discharged exteriorly of the tubs 34, 44. In some configurations, one or more additional blowers (not shown) may be provided to force air out the outlet vents to increase the drying speed.

Referring to FIG. 4, the remote system 72 can further include a heating element 106 common to both the liquid supply system 52 and the air supply system 54 for heating the liquid and air supplied to the treating chambers 36, 46. As illustrated, the heating element 106 is mounted to an exterior of the housing 80. More specifically, the heating element 106 is illustrated as mounted to an exterior of the housing 80 where the blower outlet conduit 96 wraps around the housing 80. In this location, the heating element 106 may heat air and heated liquid at the same time. Furthermore, in this location the heating element 106 is downstream of the blower 92, which protects the blower from exposure to the high temperatures generated by the heating element 106. Alternatively, the blower 92 can be located downstream from the heating element 106.

The heating element 106 can be a resistive heating element that is activated by a suitable electrical supply, such as a standard house line voltage to the heating element 106. A standard house line voltage can be between about 110 and 120 volts. The heating element 106 can also be a variable thermal energy heater, which may be accomplished by altering the duty cycle (ratio of on/off states per unit time) of a fixed wattage heater, a variable wattage heater, or a combination of both. The heating element 106 can have a power rating of less than about 1800 watts. In general, the heating system can supply electricity at 15 amps with a voltage in the range of about 110 to 120 volts to the heating element.

As illustrated, the heating element 106 can be a flow-through heater incorporated with the recirculation pump 76 and having three rings 108 encircling the housing 80. The three rings 108 may be an integral unit or may function independently of each other. As an integral unit, the rings 108 can be part of a heating coil that uses a variable duty cycle to vary the thermal energy output by the heating element 106. As independent rings 108, a desired number of rings 108 can be selectively actuated to obtain the desired thermal energy output. For example, if the heating element 106 is to run at ⅓ thermal energy output, then only one of the three rings 108 can be continuously actuated. A combination of both approaches can be used as well, such as continuously running a subset of all of the rings 108, while operating another one or more of the rings 108 according to a duty cycle.

In addition to a coiled heater or multiple-ring heater, other heating element configurations may be used. For example, it has been contemplated that the heating element 106 may be a film heater mounted on the housing 80. The film heater may comprise one film or multiple films in much the same manner that the rings 108 may be a coil or individual elements.

It has also been contemplated that the heating element 106 may be mounted to the housing 80 and positioned such that it abuts a portion of the blower outlet conduit 96. In this manner, the blower outlet conduit 96 need not wrap fully around the housing 80. Instead the blower outlet conduit 96 may abut or partially envelope the housing 80. In such an instance, the heating element 106 may be mounted to the housing 80 where the blower outlet conduit 96 abuts or partially envelops the housing 80 such that the heating element 106 may heat the liquid in the housing 80 and the air in the blower outlet conduit 96. It should be noted that while the blower 92 has been illustrated as being fluidly coupled with the blower outlet conduit 96 upstream from the heating element 106 such that heated air does not pass through the blower 92, the blower 92 may also be located downstream from the heating element 106 such that heated air is passed through the blower 92.

Referring to FIG. 5, the dishwasher 10 can be configured to selectively supply liquid and/or air to only one of the compartments 14, 16. As illustrated, a liquid manifold 110 can fluidly couple the outlet conduit 86 of the recirculation pump 76 to the first and second supply conduits 62, 66. A liquid diverter 112 can be provided in the liquid manifold 110 for selectively directing liquid to one of the first and second supply conduits 62, 66. The liquid diverter 112 can also selectively direct liquid to both the first and second supply conduits 62, 66 at the same time. Likewise, an air manifold 114 can fluidly couple the blower outlet conduit 96 of the blower 92 to the first and second air conduits 98, 100. An air diverter 116 can be provided within the air manifold 114 for selectively directing air from the blower 92 to one of the first and second air conduits 98, 100. The diverters 112, 116 can be multi-position valves.

Figure 6:
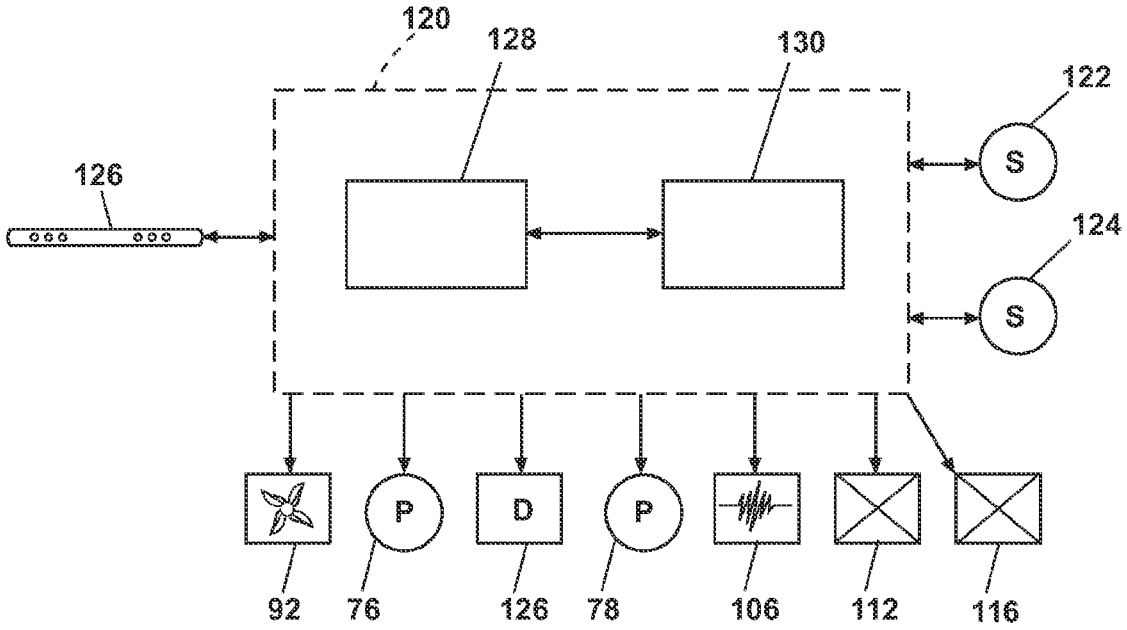
FIG. 6 is a schematic view of a controller of the dishwasher of FIG. 1.

FIG. 6 is a schematic view of a controller 120 of the dishwasher of FIG. 1. As illustrated, a single controller 120 can be provided for both compartments 14, 16, and may be operably coupled to various components of the dishwasher 10 to implement a cleaning cycle in one or both of the compartments 14, 16. For example, the controller 120 may be coupled with the recirculation pump 76 for circulation of liquid in the wash tubs 34, 44 and the drain pump 78 for drainage of liquid from the tubs 34, 44. The controller 120 may also be operably coupled with the blower 92 to provide air into the tubs 24, 44. The controller 120 may also be coupled with the heating element 106 to heat the liquid and/or air depending on the step being performed in the cycle of operation. If the heating element 106 is capable of supplying different wattages, then the controller 120 may also control that aspect of the heating element 106. The controller 120 may be coupled with the diverters 112, 116 for selectively providing air and liquid to the treating chambers 36, 46. The controller 120 may also be coupled with one or more temperature sensors 122, which are known in the art, such that the controller 120 may control the duration of the steps of the cycle of operation based upon the temperature detected in the treating chambers 36, 46 or in one of various conduits of the dishwasher 10. The controller 120 may also receive inputs from one or more other additional sensors 124, examples of which are known in the art. Non-limiting examples of additional sensors 124 that may be communicably coupled with the controller include a moisture sensor, a door sensor, a detergent and rinse aid presence/type sensor(s). The controller 120 may also be coupled to dispensers 126 provided in each of the compartments 14, 16, which may dispense a detergent during the wash step of the cycle of operation or a rinse aid during the rinse step of the cycle of operation. Alternatively, a single dispenser may be shared by both compartments 14, 16.

The dishwasher 10 may be preprogrammed with a number of different cleaning cycles from which a user may select one cleaning cycle to clean a load of utensils. Examples of cleaning cycles include normal, light/china, heavy/pots and pans, and rinse only. A control panel or user interface 126 for use in selecting a cleaning cycle can be provided on the dishwasher 10 and coupled to the controller 120. The user interface 126 can be provided above the upper compartment 16 and can include operational controls such as dials, lights, switches, and displays enabling a user to input commands to the controller 120 and receive information about the selected cleaning cycle. Alternately, the cleaning cycle may be automatically selected by the controller 120 based on soil levels sensed by the dishwasher 10 to optimize the cleaning performance of the dishwasher 10 for a particular load of utensils. The cleaning cycles may automatically dictate the supply of different fluids (i.e. air and/or water) to the treating chambers 36, 46.

The controller 120 may be provided with a memory 128 and a central processing unit (CPU) 130. The memory 128 may be used for storing control software that may be executed by the CPU 130 in completing a cycle of operation using one or both compartments 14, 16 of the dishwasher 10 and any additional software. For example, the memory 128 may store one or more pre-programmed cycles of operation that may be selected by a user and completed by one of the compartments 14, 16. A cycle of operation for the compartments 14, 16 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the compartments 14, 16 in any desired combination.

As illustrated herein, the controller 120 can be part of the remote system 72 to provide a compact and modular assembly for installation within the dishwasher 10, which also includes the pump assembly 74, filter 90, and heating element 106. However, one or more components shown as integrated with each other in the remote system 72 can also be provided separately. For example, while the heating element 106 is shown as integrated with other components in the remote system 72, each the heating element 106 can also be provided within its own independent heating system.

The above-described dishwasher 10 can be used to implement a method for operating a dishwasher having multiple, physically separate treating chambers. In operation of the dishwasher 10, air and liquid are heated by the common heating element 106, and the heated air and liquid are supplied to at least one of the treating chambers 36, 46. Depending on the supply of air and liquid to the blower outlet conduit 96 and the remote sump 82, air and liquid can be heated individually or simultaneously. FIG. 4 shows a portion of the liquid flow path of the liquid supply system 52, indicated by arrow A. As liquid enters the remote sump 82 via the sump inlet conduit 84, the liquid is heated by the heating element 106. The liquid can be heated via conduction with the housing 80. The heated liquid then exits the remote sump 82 via the outlet conduit 86, and is supplied to the liquid manifold 110 (FIG. 5). FIG. 4 also shows a portion of the air flow path of the air supply system 54, indicated by arrow B. The air can be heated by activating the blower 92 to pass air through the blower outlet conduit 96 to transfer heat from the heating element 106 by convective transfer. Alternatively, the air can be heated via the heated liquid, such as by passing air over the heated liquid to transfer heat directly from the liquid by conduction. The heated air then exits the blower outlet conduit 96, and is supplied to the air manifold 114 (FIG. 5).

In one embodiment, from the manifolds 110, 114, the heated air and liquid are supplied to different treating chambers 36, 46 by selectively diverting the heated air and liquid to different treating chamber 36, 46, using the diverters 112, 116. The heated air and liquid can be supplied to the different treating chambers 36, 46 simultaneously, or in a staggered fashion, as determined by the controller 120.

In another embodiment, liquid within the remote sump 82 may be heated by the heating element 106, but not supplied one of the treating chambers 36, 46. This may be useful in a scenario in which heated air alone is to be supplied to one of the treating chambers 36, 46. The liquid creates a heat sink around the filter 90 and absorbs at least some of the heat from the heated air and heating element 106 to aid in controlling the temperature of the filter 90 and surrounding structure. The heated liquid may then be drained from the dishwasher 10, or held until needed in one of the treating chambers 36, 46.

Figure 7:
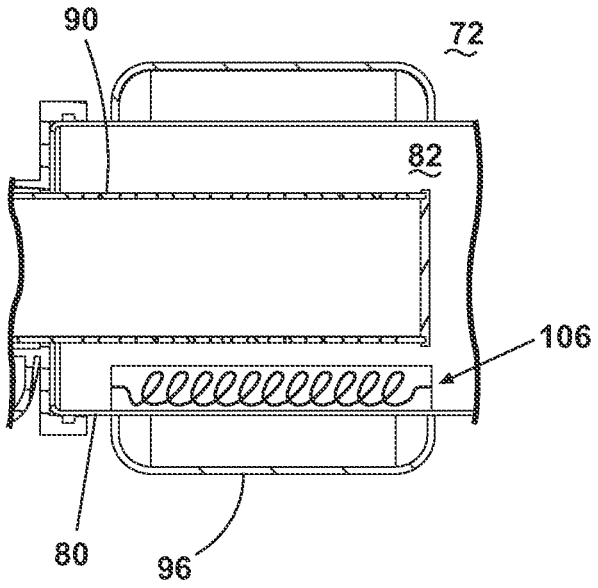
FIG. 7 is a schematic view of a portion of a remote pump/filtration/heating according to a second embodiment of the present invention.

FIG. 7 is a schematic view of a portion of the remote system 72 according to a second embodiment of the present invention. The second embodiment of the remote system 72 can be substantially identical to the first embodiment, with the exception that the heating element 106 can be mounted to the interior of the housing 80. More specifically, the heating element 106 is illustrated as mounted to the interior of the housing 80 with at least a portion of the heating element 106 located in the remote sump 82. In this location, the heating element 106 can still heat air and heated liquid at the same time, but will be at least partially immersed in liquid when liquid is present in the remote sump 82. In this embodiment, the air in the blower outlet conduit 96 can be heated by the heated liquid in addition to or alternatively to heating the air with the heating element 106. The heated liquid can transfer heat to the air by conduction, such as by through the housing 80.

Figure 8:
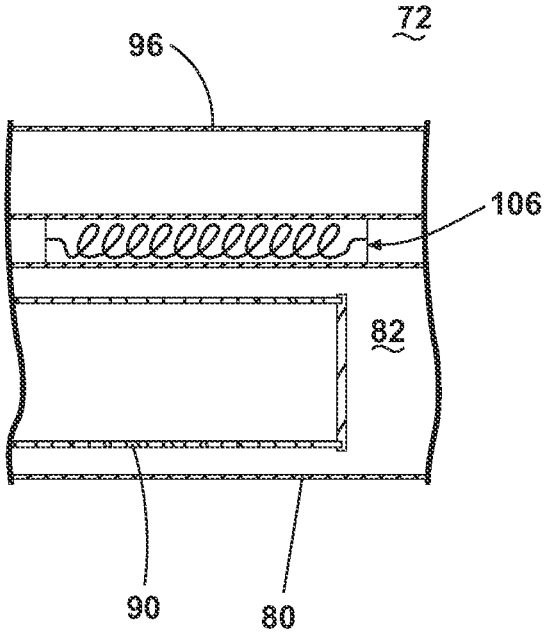
FIG. 8 is a schematic view of a portion of a remote pump/filtration/heating system according to a third embodiment of the present invention.

FIG. 8 is a schematic view of a portion of the remote system 72 according to a third embodiment of the present invention. The third embodiment of the remote system 72 can be substantially identical to the first embodiment, with the exception that the housing 80 and the blower outlet conduit 96 are provided in a side-by-side abutting relationship to define an interface between the housing 80 and the blower outlet conduit 96, and the heating element 106 is located at the interface. More specifically, the heating element 106 can be located between the housing 80 and the blower outlet conduit 96. In this location, the heating element 106 can still heat air and heated liquid at the same time, but heat will be conducted through the side walls of the housing 80 and the blower outlet conduit 96.

The multi-compartment dishwasher 10 according to the invention uses a single heating element to heat both air and liquid for each compartment 14, 16, which offers several advantages to the user. The selective supply of heated air or heated liquid to each compartment 14, 16 can prevent these resources from being used more quickly than they can be provided by the dishwasher 10. This may also result in better cleaning performance since the entire volume of heated air and/or liquid can be supplied to just one of the compartments 14, 16 at a time. Further, activating only one heating element during a cycle of operation can reduce the power consumption of the dishwasher 10. This also reduces the cost of the dishwasher 10 since fewer heating elements are required.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a first tub at least partially defining a first treating chamber and a second tub at least partially defining a second treating chamber physically separate and fluidly isolated from the first treating chamber; a first drawer at least partially defining the first tub and including a first spray arm assembly; a second drawer at least partially defining the second tub and including a second spray arm assembly; a liquid supply system selectively fluidly coupled to both of the first and second spray arm assemblies in the first and second treating chambers to selectively supply liquid thereto; an air supply system selectively fluidly coupled to both of the first and second treating chambers to selectively supply air thereto; and a heating system for heating the supplied air and liquid and comprising a heating element common to the liquid supply system and the air supply system; wherein activation of the heating element heats the liquid supplied to the one of the first and second treating chambers and the air supplied to the other of the first and second treating chambers; and wherein the first drawer is movable between a first and second position, and the first spray arm assembly moves with the first drawer, comprising: supplying air to one of the first and second treating chambers; supplying liquid to the other of the first and second treating chambers; and simultaneously heating the supplied air and the supplied liquid with the common heating element.

2. The method of claim 1, further comprising activating the heating element by supplying a standard house line voltage to a resistive heating element.

3. The method of claim 2 wherein the line voltage is between about 110 and 120 volts.

4. The method of claim 1 wherein the heating of the supplied liquid comprises immersing the heating element in the supplied liquid.

5. The method of claim 4 wherein the heating of the supplied air comprises heating the air with the heated liquid.

6. The method of claim 5 wherein the heating of the supplied air comprises transferring heat from the heated liquid by convective transfer.

7. The method of claim 1 wherein the supplying air and the supplying liquid occur simultaneously during at least a portion of the supplying air and supplying liquid.

8. A dishwasher comprising:

a first tub at least partially defining a first treating chamber;

a second tub at least partially defining a second treating chamber physically separate and fluidly isolated from the first treating chamber;

a first drawer at least partially defining the first tub and including a first spray arm assembly;

a second drawer at least partially defining the second tub and including a second spray arm assembly;

a liquid supply system selectively fluidly coupled to both of the first and second spray arm assemblies in the first and second treating chambers to selectively supply liquid thereto;

an air supply system selectively fluidly coupled to both of the first and second treating chambers to selectively supply air thereto; and a heating system for heating the supplied air and liquid and comprising a heating element common to the liquid supply system and the air supply system;

wherein activation of the heating element heats the liquid supplied to the one of the first and second treating chambers and the air supplied to the other of the first and second treating chambers; and wherein the first drawer is movable between a first and second position, and the first spray arm assembly moves with the first drawer.

9. The dishwasher of claim 8 wherein the heating element comprises a power rating of less than about 1800 watts.

10. The dishwasher of claim 9 wherein the heating system supplies a voltage in a range of about 110 to 120 volts to the heating element.

11. The dishwasher of claim 8 wherein the heating element is immersed within the liquid of the liquid supply system.

12. The dishwasher of claim 11 wherein the air supply system is in conductive contact with the liquid supply system such that the air is heated by the convective transfer of heat between the heated liquid and the air.

13. The dishwasher of claim 12 wherein the air supply system comprises an air supply conduit and the liquid supply system comprises a liquid supply conduit, with both supply conduits being in abutting relationship to define an interface between the supply conduits.

14. The dishwasher of claim 13 wherein the heating element abuts one of the supply conduits at the interface.

15. The dishwasher of claim 13 wherein the heating element is located within one of the supply conduits.

16. The dishwasher of claim 13 wherein the heating element is located between the supply conduits.

17. The dishwasher of claim 8, further comprising a diverter for selectively directing heated liquid to one of the first and second treating chambers.

18. The dishwasher of claim 8 wherein the air supply system is selectively fluidly coupled to both of the first and second treating chambers to selectively supply air thereto.

19. The dishwasher of claim 18, further comprising a diverter for selectively directing heated air to one of the first and second treating chambers.

20. The dishwasher of claim 8 wherein activation of the heating element simultaneously heats the liquid supplied to the one of the first and second treating chambers and the air supplied to the other of the first and second treating chambers.

* * * * *